US008011408B2

(12) United States Patent
Tharp et al.

(10) Patent No.: US 8,011,408 B2
(45) Date of Patent: Sep. 6, 2011

(54) LABELING APPARATUS

(75) Inventors: Clyde N. Tharp, Dayton, OH (US); James A. Makley, Springboro, OH (US)

(73) Assignee: Avery Dennison Corporation, Mentor, OH (US)

( * ) Notice: Subject to any disclaimer, the term of this patent is extended or adjusted under 35 U.S.C. 154(b) by 660 days.

(21) Appl. No.: 11/899,892

(22) Filed: Sep. 7, 2007

(65) Prior Publication Data

US 2009/0065150 A1 Mar. 12, 2009

(51) Int. Cl.
*B65C 11/02* (2006.01)
*B65C 11/00* (2006.01)

(52) U.S. Cl. ..... 156/384; 156/574; 156/387; 156/577; 156/579; 101/288; 347/109

(58) Field of Classification Search ..... 156/574
See application file for complete search history.

(56) References Cited

U.S. PATENT DOCUMENTS

| | | | | |
|---|---|---|---|---|
| 3,640,036 | A * | 2/1972 | Nakazawa et al. | 52/126.7 |
| 4,171,083 | A * | 10/1979 | Lippacher et al. | 227/69 |
| 5,065,002 | A * | 11/1991 | Tashiro et al. | 235/472.02 |
| 5,486,259 | A * | 1/1996 | Goodwin et al. | 156/384 |
| 5,642,666 | A * | 7/1997 | Petteruti et al. | 101/288 |
| 5,848,770 | A * | 12/1998 | Oliver et al. | 248/58 |
| 6,241,407 | B1 | 6/2001 | Huggins et al. | |
| 6,379,058 | B1 | 4/2002 | Petteruti et al. | |
| D486,512 | S | 2/2004 | Arnold et al. | |
| 2005/0000456 | A1 * | 1/2005 | Nock | 119/51.01 |

FOREIGN PATENT DOCUMENTS

| | | | |
|---|---|---|---|
| AU | 2003204049 | A1 * | 11/2003 |
| JP | 2005238772 | A * | 9/2005 |

* cited by examiner

*Primary Examiner* — Philip C Tucker
*Assistant Examiner* — Vicki Wu

(57) ABSTRACT

There is disclosed labeling apparatus including a portable labeler having a handle that can be suspended using a hanger assembly. The hanger assembly suspends the labeler so that the labeler is in a position ready to apply a label and with the handle at an attitude to be conveniently grasped to maneuver and operate the labeler.

19 Claims, 6 Drawing Sheets

LABELING APPARATUS

CROSS-REFERENCE TO RELATED APPLICATIONS

U.S. patent application Ser. No. 11/801,281, filed May 9, 2007 is a related application.

BACKGROUND

1. Field

The disclosed embodiments relate to labeling apparatus.

2. Brief Description of the Prior Art

The following documents are made of record: U.S. Design Pat. No. D486,512; U.S. Pat. Nos. 5,486,259; 6,241,407 and 6,379,058.

SUMMARY OF THE INVENTION

One embodiment includes a labeling apparatus which includes a labeler for printing and applying pressure sensitive labels and a hanger assembly by which the labeler can be suspended prior to or during use in labeling articles. Even though the labeler is light enough to be carried by its handle and used to print and apply labels, the hanger assembly can be used to suspend the labeler from a cable at a location above or near a conveyor on which articles to be labeled travel. A specific embodiment can comprise a labeler including a portable housing having a manually graspable handle, the housing having space to receive a supply roll of labels releasably adhered to a carrier web, a print head disposed within the housing, the web being transportable from the supply roll to the print head, a label delaminator disposed downstream of the print head and capable of peeling printed labels from the carrier web, and an applicator disposed downstream of the delaminator and capable of applying printed labels, and a hanger assembly including connectors secured at opposite sides of the housing, a hanger connectable to the connectors, and the hanger assembly supporting the labeler above the center of gravity of the labeler to enable the labeler to be hung at a position at which the handle can be readily grasped. In one configuration, the hanger can be connected or disconnected from the housing, if desired. In another embodiment, the hanger is held captive by the connectors so that it cannot be released or removed without disassembling the connectors.

BRIEF DESCRIPTION OF THE DIAGRAMMATIC DRAWINGS

DETAILED DESCRIPTION OF THE PREFERRED EMBODIMENTS

Figure 3:
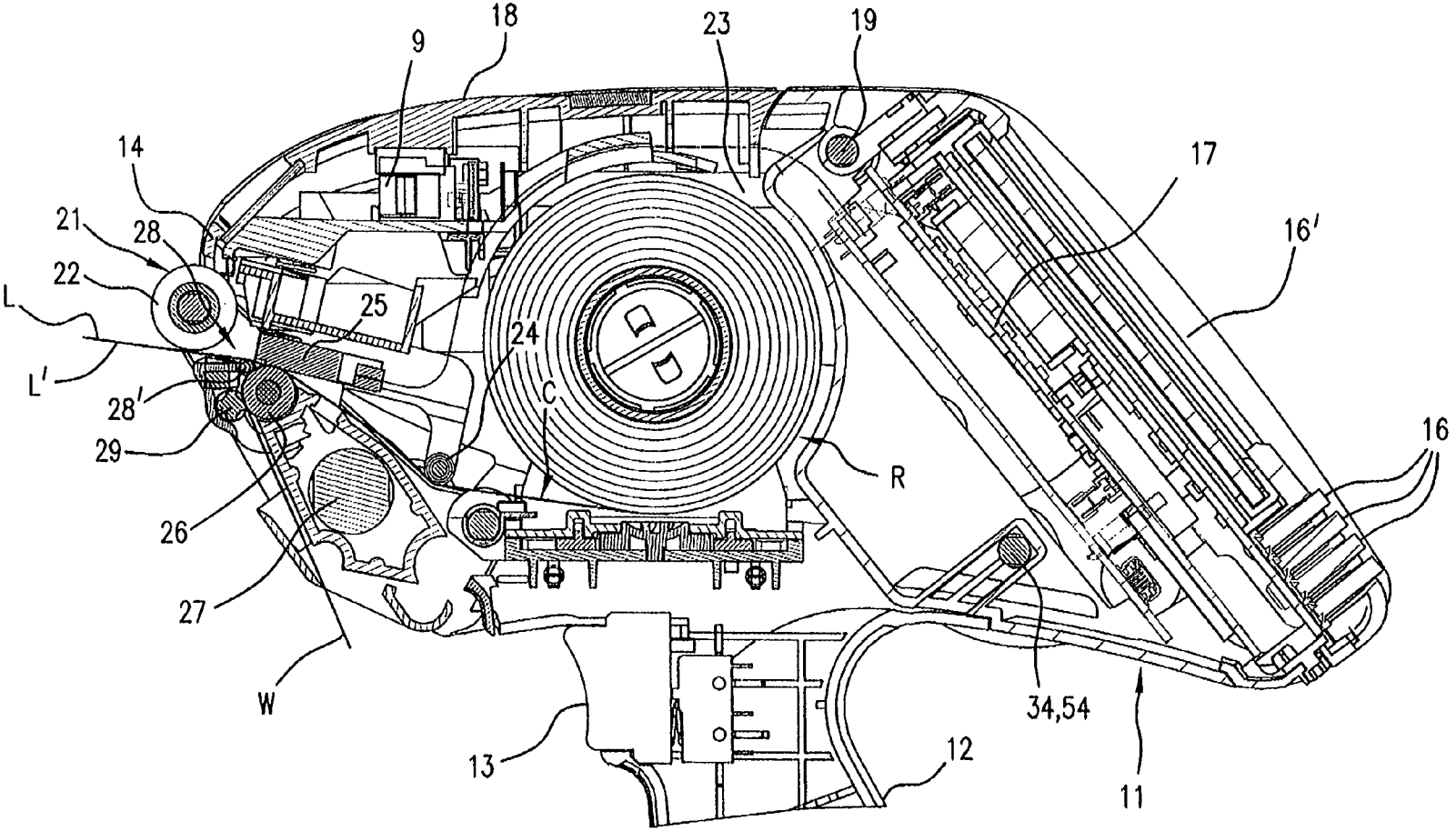
FIG. 3 is a longitudinal sectional view through the apparatus shown in FIGS. 1 and 2.

There is shown a portable apparatus generally indicated at 10. The apparatus 10 includes a labeler 10' having portable housing 11 including a manually graspable handle 12. The apparatus 10 is lightweight enough to be carried from place-to-place and used to apply labels L using the handle 12, and accordingly, the apparatus is hand-held as well as being portable. A trigger switch 13 is disposed adjacent the handle 12. The trigger switch 13 is disposed adjacent a front portion 14 of the labeler 10'. A rear portion 15 of the labeler 10' includes a key pad 16 and a touchscreen keyboard and display 16' and printed circuit boards 17 (FIG. 3). The housing 11 includes a housing section 18 pivotally mounted about a pivot 19 and releasably latched to a housing section 20. A parting line between the housing sections 18 and 20 is indicated at 18'. The handle 12 can extend away from the front portion 14 and preferably contains a rechargeable battery (not shown). The front portion 14 includes an applicator generally indicated at 21 preferably in the form of an applicator roll 22. A laser scanner 9 can be also mounted on the housing section 18 of the housing 11.

Figure 2:
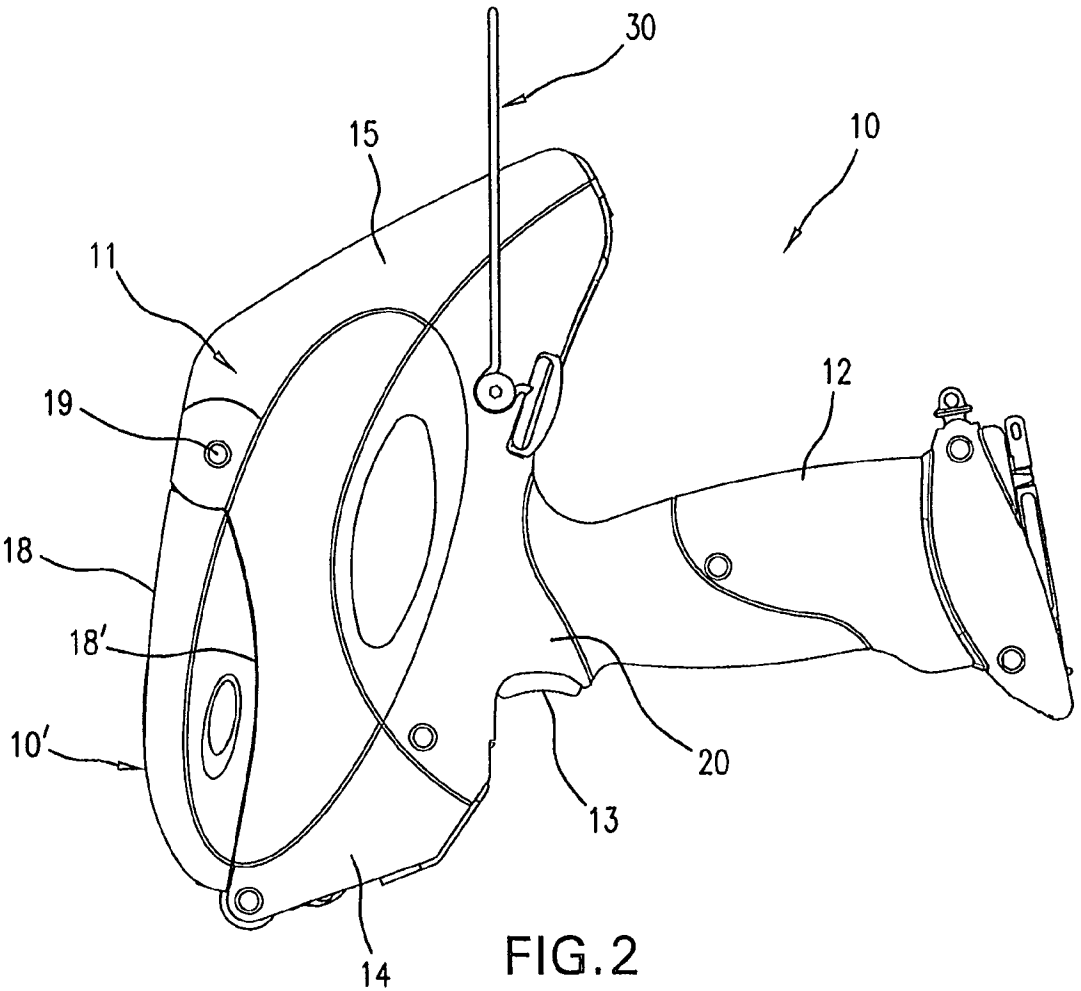
FIG. 2 is a left side elevational view of the apparatus shown in FIG. 1.

FIG. 3 shows that the housing 11 includes a space 23 for a roll R of a composite label web C. The web C includes a carrier web W to which labels L are releasably adhered by tacky or pressure sensitive adhesive L'. The composite label web C can pass along a path from the roll R to beneath a guide or direction changing roll 24 and a driven platen roll 26. The platen roll 26 is preferably comprised of a resilient material. An electric motor 27 is gear-connected to the platen roll 26 to transport or advance the composite web C and its web W while the print head 25 and the platen roll 26 cooperate to print on one label L at a time. The delaminator 28 can take the form of a small diameter roll 28' as shown in FIG. 3 or a peel edge. As the composite web C passes from the print head 25 and platen roll 26 in the downstream direction (FIG. 3), the web W is trained partially around the delaminator 28 where the web W makes an abrupt change in direction. Thus, the delaminator 28 is capable of causing the leading label L which has been printed to be delaminated or peeled from the web W. In the position shown in FIG. 2, a short trailing end portion of the leading label L still remains adhered to the web W so that the leading label L is presented in underlying or label applying relationship to the applicator roll 22. After the web W passes the delaminator 28, the web W passes between the platen roll 26 and a pressure roll 29. When the pressure roll 29 is in the operating position as shown in FIG. 3, the pressure roll 29 exerts pressure against the web W which in turn exerts pressure against the platen roll 26. Accordingly, traction is applied to the web W both at the nip between the print head 25 and the platen roll 26 and at the nip between the pressure roll 29 and the platen roll 26 when the platen roll 26 is driven. The pressure roll 29 is shown to be disposed forward of the platen roll 26 in FIG. 3. As best shown in FIG. 2, the web W exits at the front portion 14 of the housing 12 at the front of the labeler 10 a short distance after having passed between the nip of the platen roll 26 and the pressure roll 29. Further details of constructions are disclosed in my pending application Ser. No. 11/801,281 which is incorporated herein by reference in its entirety.

Figure 1:
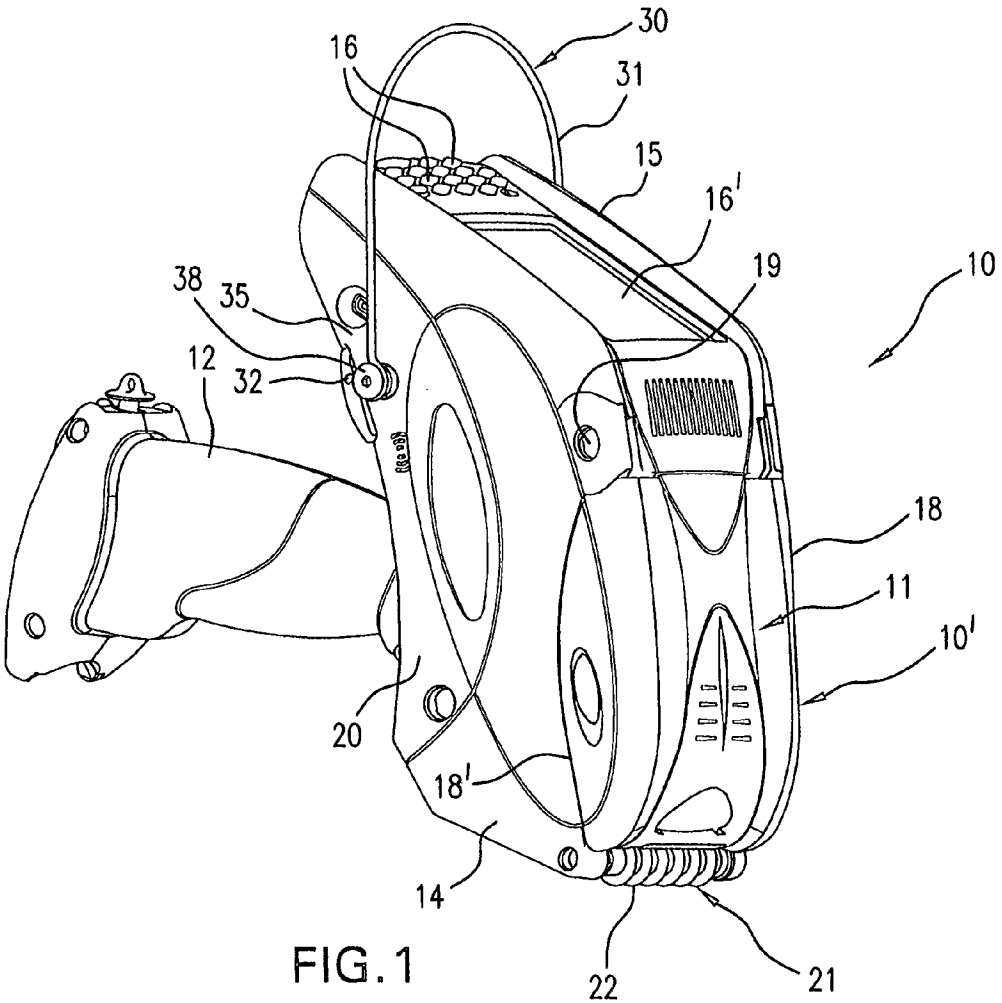
FIG. 1 is a pictorial view of labeling apparatus according to an embodiment.
Figure 4:
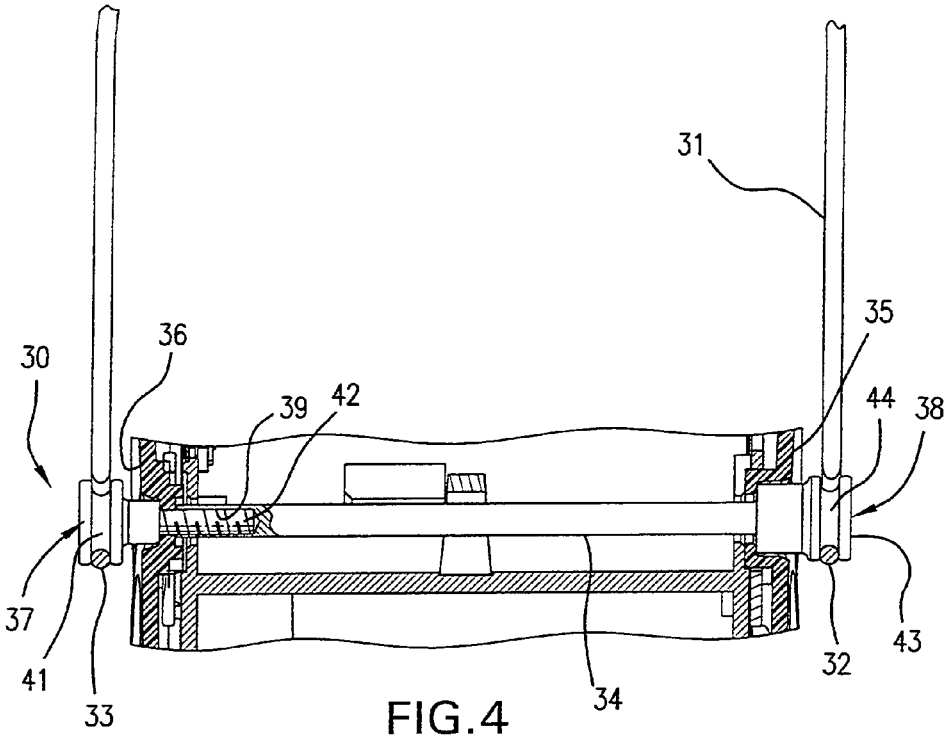
FIG. 4 is a transverse sectional view viewed from the handle showing fragmentary portions of the labeling apparatus.
Figure 5:
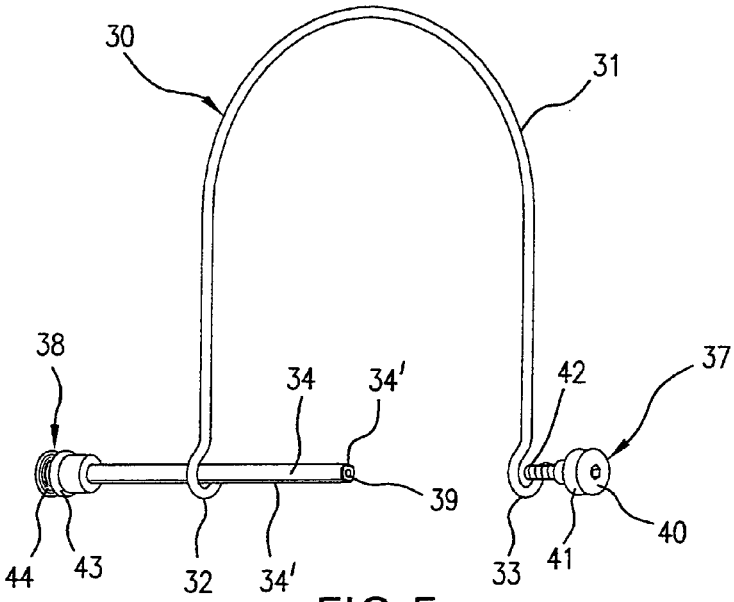
FIG. 5 is a pictorial partially unassembled view of the hanger assembly.
Figure 6:
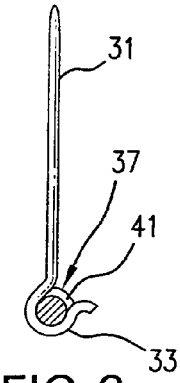
FIG. 6 is a partly sectional view of a fragmentary portion of a connector and a fragmentary portion of a hanger.

The drawings show the apparatus 10 as including a hanger assembly generally indicated at 30. The hanger assembly 30 can include a hanger 31 having a generally inverted U-shaped configuration as seen in FIGS. 1, 2 and 5. The hanger 31 can be comprised of a wire or a braided cable. A simple construction for the hanger 31 is to construct the hanger 31 from a wire that has been formed into a generally U-shaped configuration by bending opposite end or hanger portions 32 and 33 into a generally C-shaped configuration, as shown. The hanger 31 can be of one-piece construction as shown or it can be a composite of two or more pieces. The hanger assembly 30 may include a rod or shaft 34 which can preferably extend through the housing 11 and most preferably through side panels or side plates 35 and 36 of the housing (as best shown in FIG. 4). The shaft 34 serves not only to hold the housing together, but also to mount connectors 37 and 38 which straddle the side plates 35 and 36. The shaft 34 has an end portion with a threaded axially extending hole 39. The connector 37 has a grooved connector member 40, a groove 41 in the connector member 40 and a threaded portion 42. The threaded portion 42 is received in the threaded hole 39. The connector 38 may be formed integrally with the shaft 34 as shown. The connector 38 comprises a grooved connector member 43 and a groove 44 in the connector member 43.

The shaft 34 can be inserted through the side plates of the housing so that the connector 38 is adjacent the side plate 35. The threaded portion 42 can then be threaded into the threaded hole 39. Thereafter, the hanger 31 can be snapped into the grooves 41 and 44 at respective end portions 33 and 32. Accordingly, the hanger 31 is releasably connected to the connectors 37 and 38. The end portions 32 and 33 extend for more than 180 degrees so as releasably capture the connectors 37 and 38. The shaft 34 cannot rotate in the housing 11 because the shaft 34 has opposed flats 34'.

The location of shaft 34 and the connectors 37 and 38 is such that the labeler 10' is suspended or hangs from the hanger 31 in an orientation as shown in FIGS. 1 and 2 where the handle 12 can be readily grasped and a label L can be applied to an article near or below the level of the labeler 10'. The handle 12 is shown to be generally horizontal. The supply-roll-containing labeler 10' has a center of gravity slightly below the shaft 34 and the connectors 37 and 38 as viewed in FIG. 1 and 2 so that the labeler 10' automatically assumes this attitude when suspended.

When the hanger 31 is not needed to suspend the labeler 10', the hanger 31 can be pivoted counterclockwise from the FIG. 2 position clear of the touchscreen 16'. Because of friction between the hanger 31 and the connectors 37 and 38, the hanger 31 will stay in the position into which it has been pivoted until it is intentionally moved.

Figure 7:
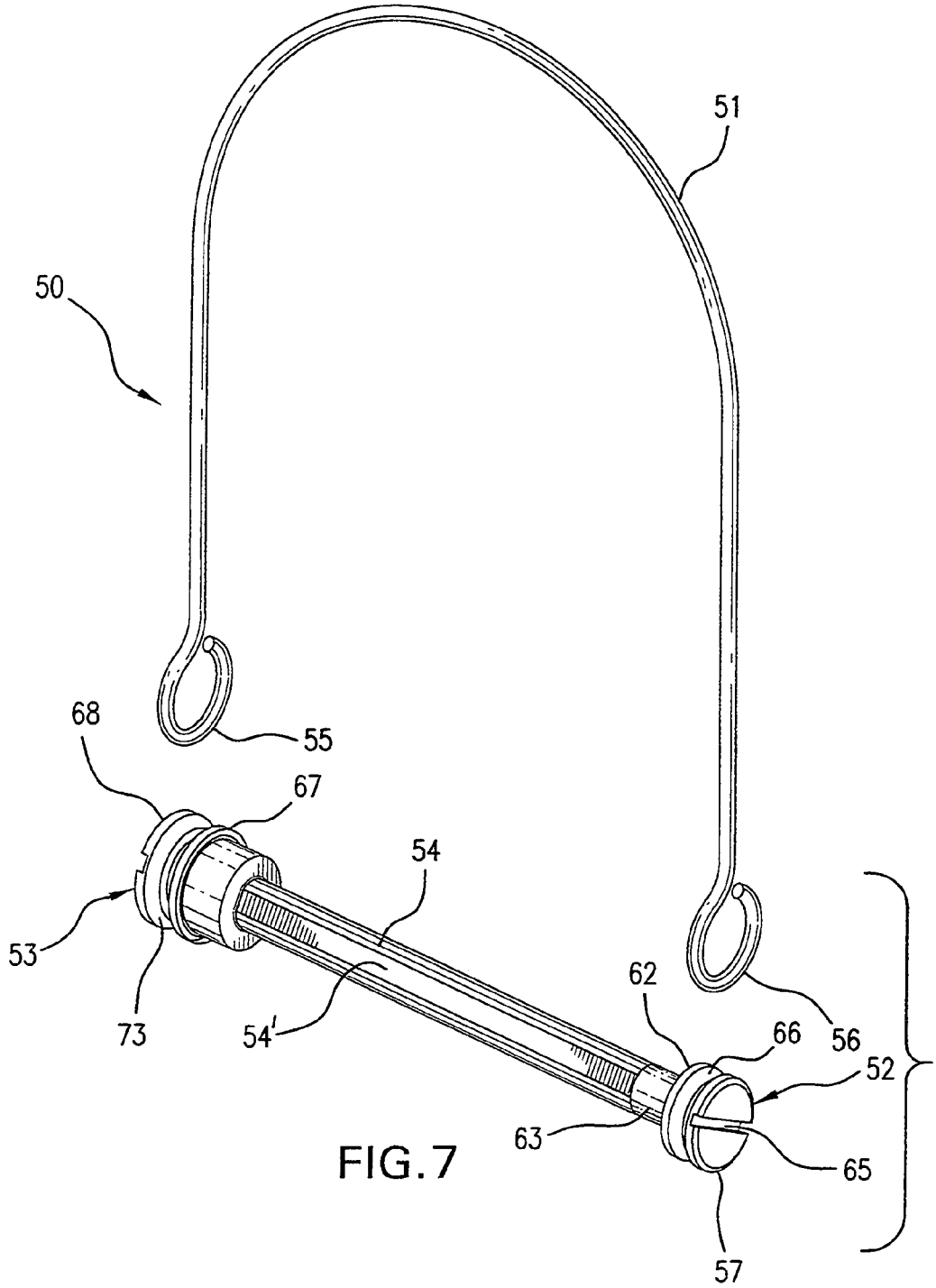
FIG. 7 is a partially exploded, pictorial view of a hanger and shaft and connectors of another embodiment of a hanger assembly.
Figures 8, 9:
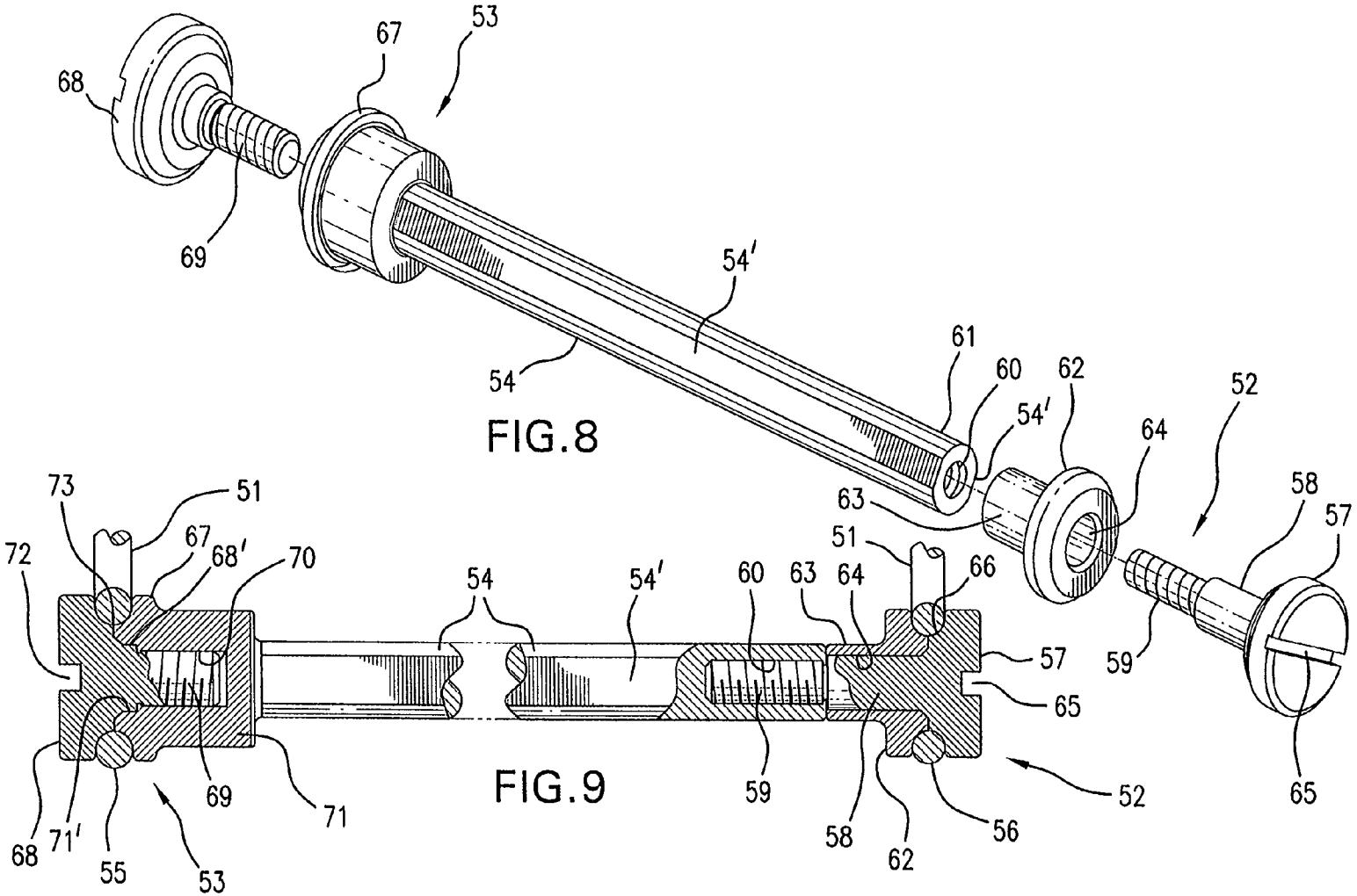
FIG. 8 is an exploded pictorial view of the shaft and the connectors shown in FIG. 7.
FIG. 9 is an assembled sectional view of the shaft and connectors and fragments of the hanger of the embodiment of FIGS. 7 through 9.

Referring to the embodiment of FIGS. 7, 8 and 9, the hanger assembly generally indicated at 50 is shown to include a generally U-shaped hanger 51 and connectors 52 and 53 on a shaft 54. The shaft 54 have opposite flats 54'. The connectors 52 and 53 and the shaft 54 occupy the same position as the connectors 37 and 38 and the shaft 34 and serve to capture end portions or hanger portions 55 and 56 of the hanger 51.

With reference to FIGS. 8 and 9, the connector 52 is shown to include a connector member or groove portion 57 having an axial hub 58 and a threaded portion 59. The threaded portion 59 can be threadably received in a threaded hole 60 in end portion 61 in the shaft or rod 54. A connector member or groove portion 62 has a hub or sleeve 63 received about the hub 58. The hub 63 has a through-hole 64 which is preferably only slightly larger than the outside of the hub 58 for clearance purposes. The groove portion 57 has a slot 65 capable of receiving a screw driver or a coin to tighten or loosen the groove portion 57. The slot 65, the groove portion 57, the hub 58, the threaded portion 59 and the shaft 54 are axially aligned. As shown in FIG. 9, the groove portions 57 and 63 are face-to-face to provide a groove 66 which captures the end portion 56 of the hanger 51. The end portion 56 is an essentially closed configuration or loop so that the only way the end portion 56 can become separated from the connector 52 is by unscrewing the connector portion 57 from the shaft 54 and separating the connector portion 57 from the connector portion 62. It is an easy matter to assemble or disassemble the connector 52.

FIGS. 8 and 9 also show the connector 53 as being separable. A connector member or groove portion 67 may be formed integrally with the shaft 54. Another connector member or groove portion 68 is shown to have a shoulder or hub 68' and a threaded portion 69. The shoulder 68' is received in a bore 71' and the threaded portion 69 is threadably received in a threaded hole 70 in an enlarged portion 71 of the shaft 54. The shoulder 68' absorbs load applied to the groove portion 68 when a load is applied to the hanger 51. The connector portion 68 also has a slot 72 to receive a screwdriver or a coin, as with the slot 65. When the connector member 68 is screwed into the enlarged portion 71, the groove portions 67 and 68 form a groove 73 to receive and capture end portion 55 of the hanger 51. The connector members 67 and 68 are face-to-face and axially located with respect to the axis of the shaft 54. As with end portion 56, the end portion 55 is an essentially closed configuration or loop so that the only way the end portion 56 can become separated from the connector 53 is by unscrewing the connector member 68 from the connector member 67.

It is preferred to construct the connectors 37 and 38, the shaft 34 and the hanger 31 and the connectors 52 and 53, the shaft 54 and the hanger 51 from metal such as steel, although other materials such as suitable plastics can be used.

Other embodiments and modifications will suggest themselves to those skilled in the art, and all such of these as come within the spirit of this invention are included within its scope as best defined by the appended claims.

We claim:

1. A labeling apparatus, comprising:

a labeler including a portable housing having a manually graspable handle, the housing having space to receive a supply roll of labels releasably adhered to a carrier web, a print head disposed within the housing, the web being transportable from the supply roll to the print head, a label delaminator disposed downstream of the print head and capable of peeling printed labels from the carrier web, an applicator disposed downstream of the delaminator and capable of applying printed labels, and a hanger assembly including a shaft extending through the housing, connectors on the shaft external to the housing, and an inverted generally U-shaped hanger member connected to the connectors, the shaft being above the center of gravity of the labeler to hang at a position in which the handle can be readily grasped and to apply a label.

2. A labeling apparatus as defined in claim 1, wherein the hanger member includes a pair of hanger portions, wherein each connector includes a pair of connector members, wherein each connector member of the pair forms part of a groove to receive a hanger portion of the hanger member.

3. A labeling apparatus as defined in claim 2, wherein each hanger portion is in an essentially closed configuration.

4. A labeling apparatus as defined in claim 2, wherein one connector member of each pair of threadably received by the shaft.

5. A labeling apparatus as defined in claim 2, wherein one connector member of one pair is formed integrally with the shaft and another connector member is threadably secured to the shaft to provide the groove.

6. A labeling apparatus as defined in claim 2, wherein one connector member of one pair includes a hub threadably received by the shaft and another connector member is received on the hub.

7. A labeling apparatus comprising:

a labeler including a portable housing having a manually graspable handle, the housing having space to receive a supply roll of labels releasably adhered to a carrier web, a print head disposed within the housing, the web being transportable from the supply roll to the print head, a label delaminator disposed downstream of the print head and capable of peeling printed labels from the carrier web, and an applicator disposed downstream of the delaminator and capable of applying printed labels, and a hanger assembly including connectors secured at opposite sides of the housing, a hanger connectable to the connectors, and the hanger assembly supporting the labeler above the center of gravity of the labeler to enable the labeler to be hung at a position at which the handle can be readily grasped;

wherein the housing has side panels, wherein the hanger assembly includes a shaft extending through the side panels, and wherein the connectors are connected to the shaft.

8. A labeling apparatus as defined in claim 7, wherein the hanger is pivotally connected to the connectors to enable the hanger to pivot to different positions relative to the labeler.

9. A labeling apparatus as defined in claim 7, wherein the connectors have generally annular grooves, wherein the hanger comprises a one-piece wire having C-shaped end portions snapped-fitted into the grooves.

10. A labeling apparatus as defined in claim 7, wherein the connectors include generally annular grooves, and the hanger is pivotally captured in the grooves.

11. A labeling apparatus as defined in claim 7, wherein the hanger is releasably connected to the connectors.

12. A labeling apparatus as defined in claim 7, wherein the hanger assembly hangs the labeler with the applicator disposed downwardly of the center of gravity of the labeler and with the handle at or near the horizontal attitude.

13. A labeling apparatus as defined in claim 7, wherein the labeler includes a display, wherein the hanger is pivotal to a position when not in use so as not to visually obstruct the display.

14. A labeling apparatus as defined in claim 7, wherein the hanger is generally U-shaped.

15. A labeling apparatus as defined in claim 7, wherein the hanger is substantially rigid, the hanger can be frictionally pivotally connected to connectors, so that when the labeler is not being hung, the hanger will stay in the position into which the hanger has been pivoted.

16. A labeling apparatus comprising:

a labeler including a portable housing having a manually graspable handle, the housing having space to receive a supply roll of labels releasably adhered to a carrier web, a print head disposed within the housing, the web being transportable from the supply roll to the print head, a label delaminator disposed downstream of the print head and capable of peeling printed labels from the carrier web, and an applicator disposed downstream of the delaminator and capable of applying printed labels, and a hanger assembly including connectors secured at opposite sides of the housing, a hanger connectable to the connectors, and the hanger assembly supporting the labeler above the center of gravity of the labeler to enable the labeler to be hung at a position at which the handle can be readily grasped;

wherein the hanger member includes a pair of hanger portions, wherein each connector includes a pair of connector members, wherein each connector member of the pair forms part of a groove to receive a hanger portion of the hanger member.

17. A labeling apparatus as defined in claim 7, wherein each hanger portion is in an essentially closed configuration.

18. A labeling apparatus as defined in claim 7, wherein one connector member of each pair of connectors is threadably received by the shaft.

19. A labeling apparatus as defined in claim 7, wherein one connector member of one pair is formed integrally with the shaft and another connector member is threadably secured to the shaft to provide the groove.

* * * * *